US007331318B2

(12) United States Patent
Schweizer

(10) Patent No.: US 7,331,318 B2
(45) Date of Patent: Feb. 19, 2008

(54) CAMSHAFT ADJUSTER WITH PLAY-FREE LOCKING

(75) Inventor: Steffen Schweizer, Oberboihingen (DE)

(73) Assignee: Hydraulik-Ring GmbH, Marktheidenfeld (Altfeld) (DE)

( * ) Notice: Subject to any disclaimer, the term of this patent is extended or adjusted under 35 U.S.C. 154(b) by 94 days.

(21) Appl. No.: 11/340,021

(22) Filed: Jan. 26, 2006

(65) Prior Publication Data

US 2006/0201463 A1 Sep. 14, 2006

(30) Foreign Application Priority Data

Jan. 28, 2005 (DE) ..... 10 2005 004 281

(51) Int. Cl.
*F01L 1/34* (2006.01)

(52) U.S. Cl. ..... 123/90.17; 123/90.15; 123/90.16; 92/5 L; 92/122; 464/1; 464/2; 464/160

(58) Field of Classification Search ..... 123/90.17
See application file for complete search history.

(56) References Cited

U.S. PATENT DOCUMENTS 5,836,276 A 11/1998 Iwasaki et al.
6,276,322 B1 * 8/2001 Sekiya et al. ..... 123/90.17
6,439,182 B1 * 8/2002 Sugiura et al. ..... 123/90.17
6,474,280 B2 11/2002 Maeyama et al.
6,497,208 B2 12/2002 Miyasaka
6,520,132 B2 * 2/2003 Todo ..... 123/90.17
6,837,200 B2 * 1/2005 Ichinosawa ..... 123/90.17

FOREIGN PATENT DOCUMENTS

| | | |
|---|---|---|
| DE | 19623818 | 12/1996 |
| DE | 19742947 | 4/1998 |
| DE | 10038082 | 3/2001 |
| DE | 10149056 | 7/2002 |
| JP | 2001050018 | 2/2001 |

* cited by examiner

*Primary Examiner*—Thomas Denion
*Assistant Examiner*—Kyle M. Riddle
(74) *Attorney, Agent, or Firm*—Haynes and Boone, LLP

(57) ABSTRACT

Camshaft adjusters according to the swivel motor principle may be provided with a bar which arrests the rotor in a position relative to the stator. A bar according to the invention is provided with two portions, between which a change of power transmission takes place during the arresting process.

10 Claims, 9 Drawing Sheets

CAMSHAFT ADJUSTER WITH PLAY-FREE LOCKING

CROSS REFERENCE

This application claims priority to German application number 10 2005 004 281, filed Jan. 28, 2005.

BACKGROUND OF THE INVENTION

The invention relates to a camshaft adjuster with play-free locking according to the preamble of Claim 1.

There are numerous camshaft adjusters. Apart from helically toothed camshaft adjusters, camshaft adjusters according to the swivel motor principle are widely used. As a rule swivel motor camshaft adjusters have a housing which is also called a stator and in which a rotor with an arbitrary number of blades can move. Chambers for accommodating a hydraulic fluid such as, for example, a motor oil, are formed between webs of the stator and the blades of the rotor. The freedom of motion between the rotor and the stator may optionally be limited or impeded by a bar. Bars of this kind or locking pins are frequently spring-biased. The bar is only moved into an unlocked position when a spring force is overcome. A hydraulic pressure acting on the blade or blades of the rotor then allows a swivelling movement to take place within an angle of rotation by means of which a connected camshaft of an internal combustion engine is changed in terms of its position and therefore its opening and closing times with respect to a driving shaft, such as a crankshaft. A torque is transmitted via the stator from the crankshaft or another shaft of the internal combustion engine to rotor and the connected camshaft. The locking bar must be designed such that the entire torque can be transmitted via the bar. The bar should also lock securely if required and not jam such that unlocking is not guaranteed in another state.

Numerous proposals for locking pins, which are frequently biased by a spring, can be found in the patent literature. FIG. 2 of U.S. Pat. No. 5,836,276 shows a pin parallel to the camshaft which is to lock a rotor with respect to a cover. The end which projects into the cover is of frustoconical formation. The receptacle in the cover is distinctly larger. A pin of this kind would also have to be adjustable frequently during operation, and a non-super-audible rattling noise would probably be perceptible under load changes on account of the play between the housing, the cover and the pin.

Similar dimensions would also appear to be found in the case of the multi-stepped pin of FIG. 4 from DE 101 49 056 A1. The lower end is frustoconical in order to accommodate the bevelled ends of the pin. The frustoconical end of the receptacle of the cylindrically shaped tip of the locking pin is of larger dimensions than the actual cylindrical tip. Rattling noises can also be heard in this kind of configuration of the locking unit of a camshaft adjuster, FIG. 5*a* of U.S. Pat. No. 6,497,208 B2 shows that the frustoconical tip of the locking pin can be pushed into a round trough of approximately the same dimensions. There is only slight line contact between the two components. The entire torque must be transmitted via the line contact between the two connected shafts of the internal combustion engine. Pins which have receptacles and are better adapted to one another in terms of their dimensions can be found in JP 2001050018 A, DE 100 38 082 A1, in particular FIG. 11, U.S. Pat. No. 6,474,280 B2, in particular FIG. 1, and FIG. 3 of DE 197 42 947 A1. The Japanese publication shows a cylindrical pin with a cylindrical receptacle. In U.S. Pat. No. 6,474,280 B2 and DE 100 38 082 A1 the frustoconical tip of the locking pin engages in the locking state in a frustoconical trough which is dimensioned to correspond exactly to the pin. DE 197 42 947 A1 comprises further dimensioning of a pin, the multiform contour of which can only be produced at a high cost.

DE 196 23 818 A1, in particular FIG. 1, discloses a locking pin which presents an oval torsion-like surface in its front part. Manufacturing qualities have to be taken into account here too for the purpose of exact play.

SUMMARY OF THE INVENTION

It is obvious that the professional world has for a long time been searching for a locking pin or bar which, during operation, even at high angle of rotation velocities, is securely caught, equally securely unlocked, can be easily produced, can transmit the entire torque from the stator to the rotor and generates as little rattling noise as possible under substantial load changes.

A locking bar according to the invention with a corresponding receptacle according to Claim 1 approaches these idealized requirements by way of inevitable compromises between the numerous requirements. Advantageous developments can be found in the dependent claims.

A camshaft adjuster which operates according to the swivel motor principle has a rotor and a stator. A driving shaft is connected to the rotor, and the driven shaft is connected to the stator. Together the stator and the rotor form at least two hydraulic chambers acting in opposition. If one hydraulic chamber expands, the other hydraulic chamber is reduced accordingly. Ideally the pressure of one hydraulic chamber acts on one side of a blade of the rotor and thus moves the rotor in the direction of the other hydraulic chamber. The camshaft adjuster also comprises an arresting unit. The arresting unit has components such as a plate, a biasing means and a bar. If the biasing means is a spring means, the plate forms a spring plate. The arresting unit may be disposed both in the rotor and in the stator. The bar has a corresponding receiving opening in the respective other component, stator or rotor, which corresponds to the shape of the bar tip, which can enter the receiving opening. The function of the arresting unit is to afford a firm connection or anchorage when the rotor is in a certain position relative to the stator. The rotor and the stator are arrested. The actual bar may be divided into a plurality of portions. A first portion is an advance power transmission portion. As the bar may have a round or an oval or an elliptical shape, the first portion has a first diameter. This diameter is either the absolute diameter or an average diameter of an elliptical shape, depending on the shape. In addition to the first portion, the bar has a further, second portion. The second portion performs the wedging function. The rotor and the stator are arrested once wedging has taken place. The wedging portion has a particular diameter. Both the first diameter and the second diameter are in the corresponding receiving opening when the camshaft adjuster is in the arrested state and are enclosed by the subassembly lying opposite an arresting unit. The actual receiving opening has a larger diameter than the first portion, the advance power transmission portion. If the arresting unit enters the receiving opening on account of, for example, the reduction of hydraulic pressure against the biasing means on the bar, arresting firstly takes place via the advance power transmission portion. However this arresting process is still subject to play. The second portion, the wedging portion, takes hold when the bar enters further. A change in the arresting action takes place. The power which is introduced into the stator is diverted following the change of power transmission from the advance power transmission portion to the wedging portion. One of the advantageous aspects of the power transmission change lies in the fact that an advance power transmission portion which initially exhibits substantial play ensures that the rotor is securely caught in position relative to the stator at high rotational speeds. The rotor is firstly braked relative to the stator. The wedging portion takes over the power transmission function in the course of the arresting process. Play is minimized by the wedging action. It is hardly possible for further rattling noises to occur. Few transverse forces occur on account of the low level of play during wedging. Wear is minimized. However the catching process, which is subject to play, is carried out with a large bar diameter. More material is available during the catching process.

It is advantageous to dispose the arresting unit horizontally relative to the driving shaft. However the principle of the invention can also be applied to a vertical arresting unit which is disposed perpendicularly to the driving shaft.

According to an advantageous aspect of the invention, the wedging counterpiece for the wedging portion may be formed from a mandrel which points in the direction of propulsion, the direction of movement into the locking position, contrary to the bar. The reversal of direction between the wedging counterpiece and the bar results in a saving in construction space, and the housing or cover can therefore be of a thinner design. The shortest construction space is achieved if the mandrel and the longitudinal axis of the bar lie on one and the same axis.

The actual mandrel may be circular overall. It may have a frustoconical partial contour. It may consist of straight portions in part. The important factor is to provide a sufficient wedging face. A combination of a circular portion and a straight portion is favourable in the case in which an additional underflow face is to be offered for the bar in order that the bar can be pushed back into its non-arrested position against the biasing means via a hydraulic medium.

The dual functionality of the same bar regions can also be characterized in that the two diameters, the diameter for the advance power transmission portion and the diameter for the wedging portion, lie in one and the same plane of the bar.

The wedging portion has a contour such that the wedging effect is derived through surface contact. Frustoconical portion contours are particularly suitable, as the contours are easy to produce in terms of manufacturing engineering. The corresponding receiving opening is designed such that it fits together with the contour of the wedging portion by means of a positive engagement.

Considered from the outside, the bar may have the shape of a cylindrical rod which has a frustoconical diameter in the region of the wedging portion. In this case the first diameter is a diameter of a circular plane and the second diameter is the diameter of a cone frustum.

Because the camshaft adjuster is to be easily lockable and also easily unlockable, the bar is provided with pressure faces under which a hydraulic medium can easily flow. By means of appropriate duct structures and the provision of further bearing faces or pressure faces such as, for example, a circumferential collar, the pressure faces can be widened against the biasing force in order to apply the required counterforce against the biasing spring with a lower pressure. The circumferential collar is dimensioned in terms of its width such that it simultaneously assumes a guide function for the mobile pin. In a sectional representation the bar has the appearance of a cap with an increased tip. The cap shape forms a central opening which can serve as a receiving space for the biasing means. The material saving which is achieved makes the bar as a whole lighter, and it can therefore be moved and displaced by a smaller force, both the biasing force and the restoring force. The action of the biasing means on the plate creates a stationary position for the biasing means.

The arresting unit may comprise further ducts in order that a hydraulic medium may flow under further faces, for example at the receiving opening. One variant consists, for example, in the mandrel of the receiving space being of a smaller height than the space which is enclosed by the wedging portion. The hollow space which is formed from this is intended for a hydraulic medium.

BRIEF DESCRIPTION OF THE DRAWINGS

The invention can be more easily understood with reference to the figures, wherein.

DESCRIPTION OF PREFERRED EMBODIMENTS

Figure 1:
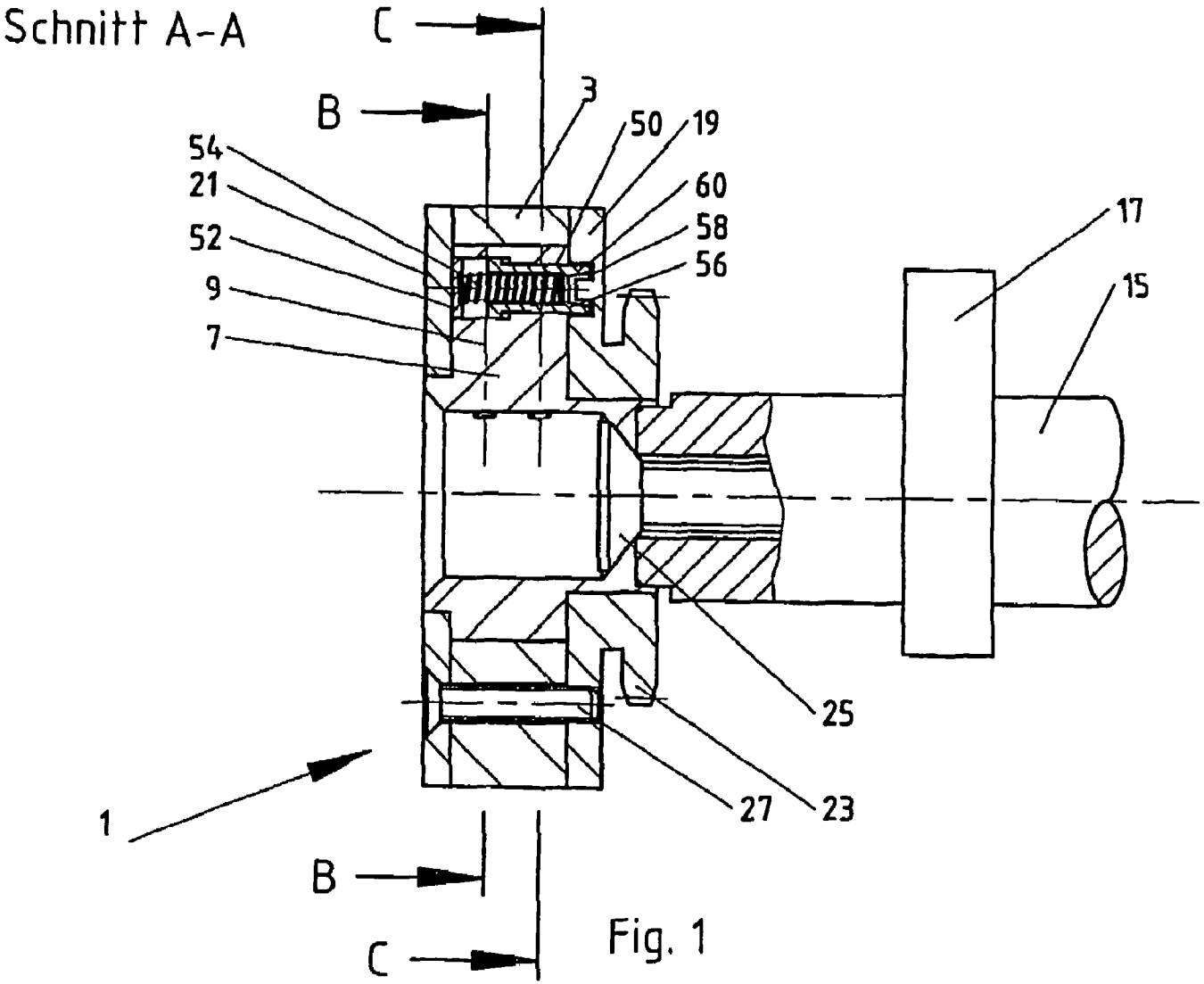
FIG. 1 is a section through a camshaft adjuster according to the invention with indicated camshaft.
Figure 2:
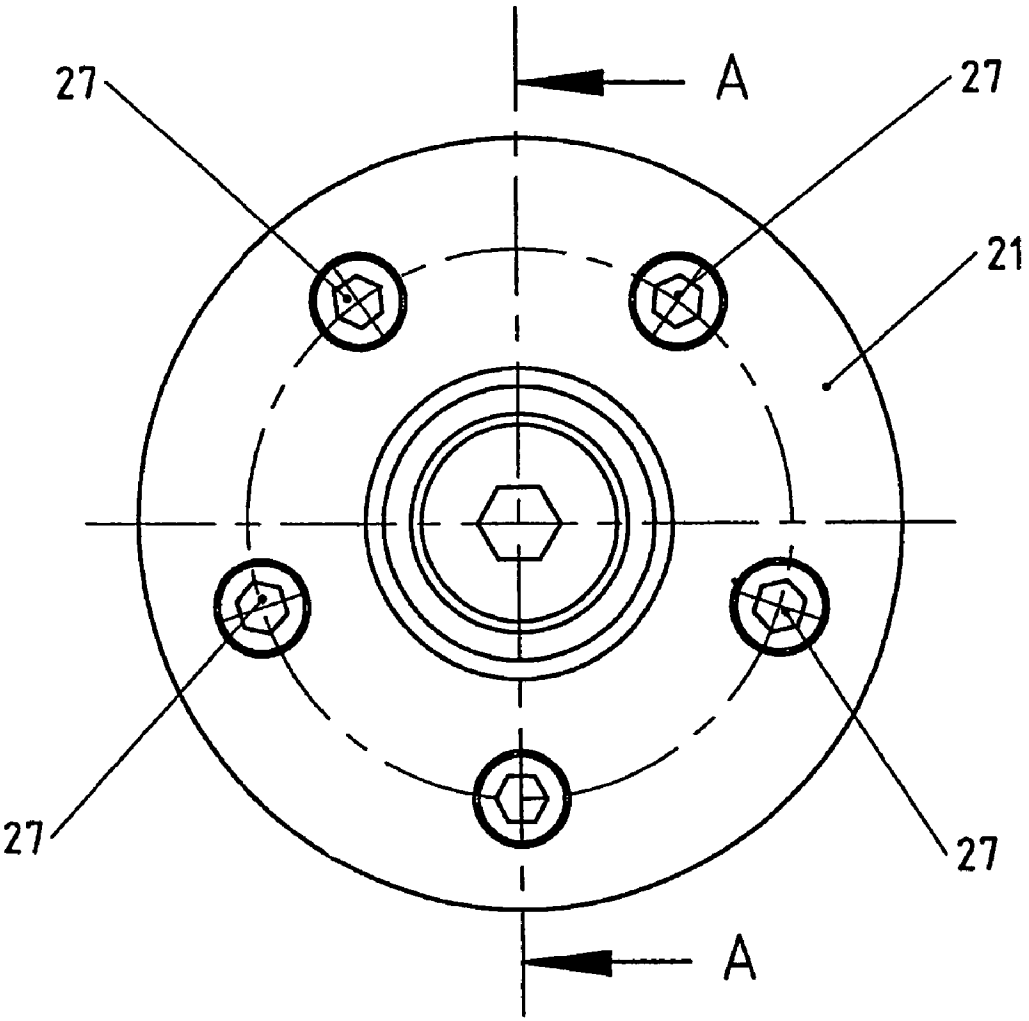
FIG. 2 is a plan view with a sectional marking for FIG. 1.
Figure 3:
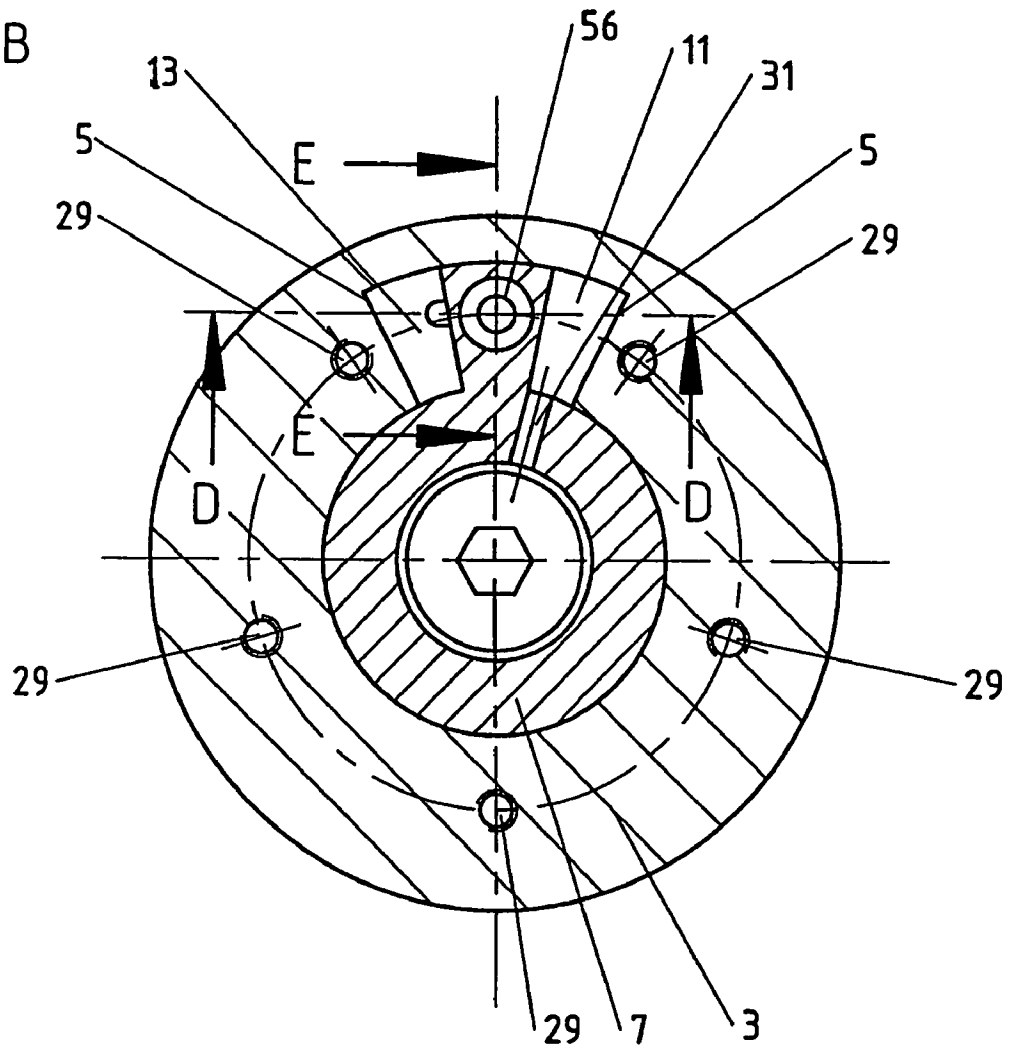
FIG. 3 represents a partly sectional camshaft adjuster along the section BB of FIG. 1.
Figure 4:
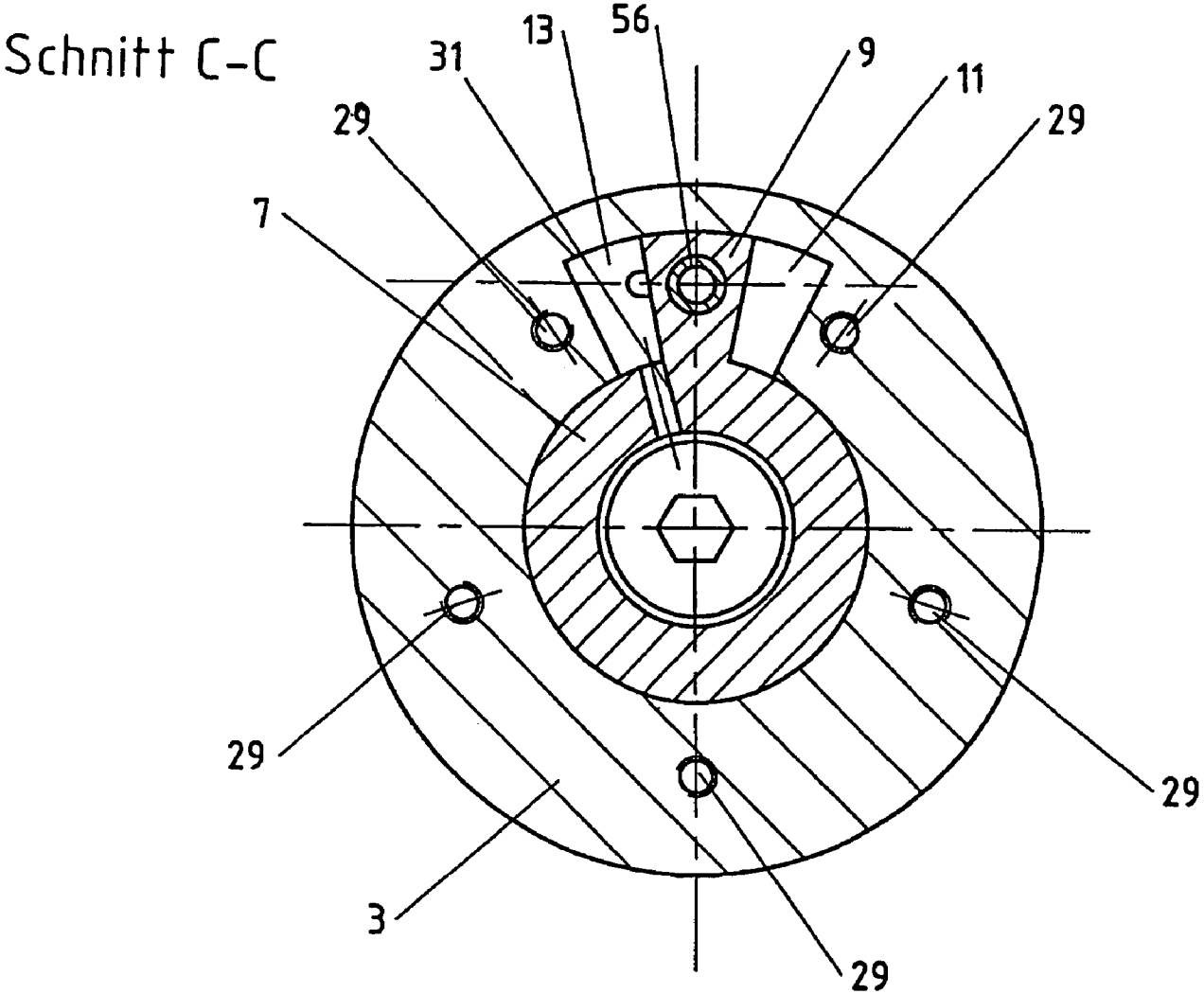
FIG. 4 represents a partly sectional camshaft adjuster along the section CC of FIG. 1, FIGS. 5, 6 and 7 represent different views of a first embodiment of a camshaft adjuster according to the invention with arresting unit.

FIG. 2 is a plan view onto one side of a camshaft adjuster which is outlined in FIG. 1 with indicated camshaft. Further sections can be seen in FIG. 3 and FIG. 4. The camshaft adjuster 1 is engaged with a shaft 15, on which a cam 17 is represented. FIG. 1 shows that the camshaft adjuster can be connected both by a connecting screw 25 and by a non-positive engagement between the shaft 15 and the sprocket wheel 23. The cover 21 of a camshaft adjuster 1 is held together by fastening means such as clamping screws 27. The housing 19 and the cover 21 close off hollow spaces which are represented as hydraulic chambers 11 and 13 in FIGS. 3 and 4. The chambers 11, 13 can be supplied with a hydraulic medium through oil ducts 31. The clamping screws 27 pass through screw guides 29 which are provided in the stator 3 of the camshaft adjuster 1. The screw guides 29 of the stator 3 may advantageously lie in webs 5. The rotor 7, which may have one or more blade(s) 9, is located in the stator 3. According to FIG. 3 and FIG. 4, an arresting unit 50 with a bar 56 may lie in a blade 9. In the locked position the bar 56 enters the receiving opening 58, which may be provided in the housing 19. The locked position is a first-stage position resulting from a biasing means 54 pressing onto the bar 56, supported against the plate 52, and thus pushing a part of the bar 60 into the receiving opening 58 with a biasing force.

Figure 5:
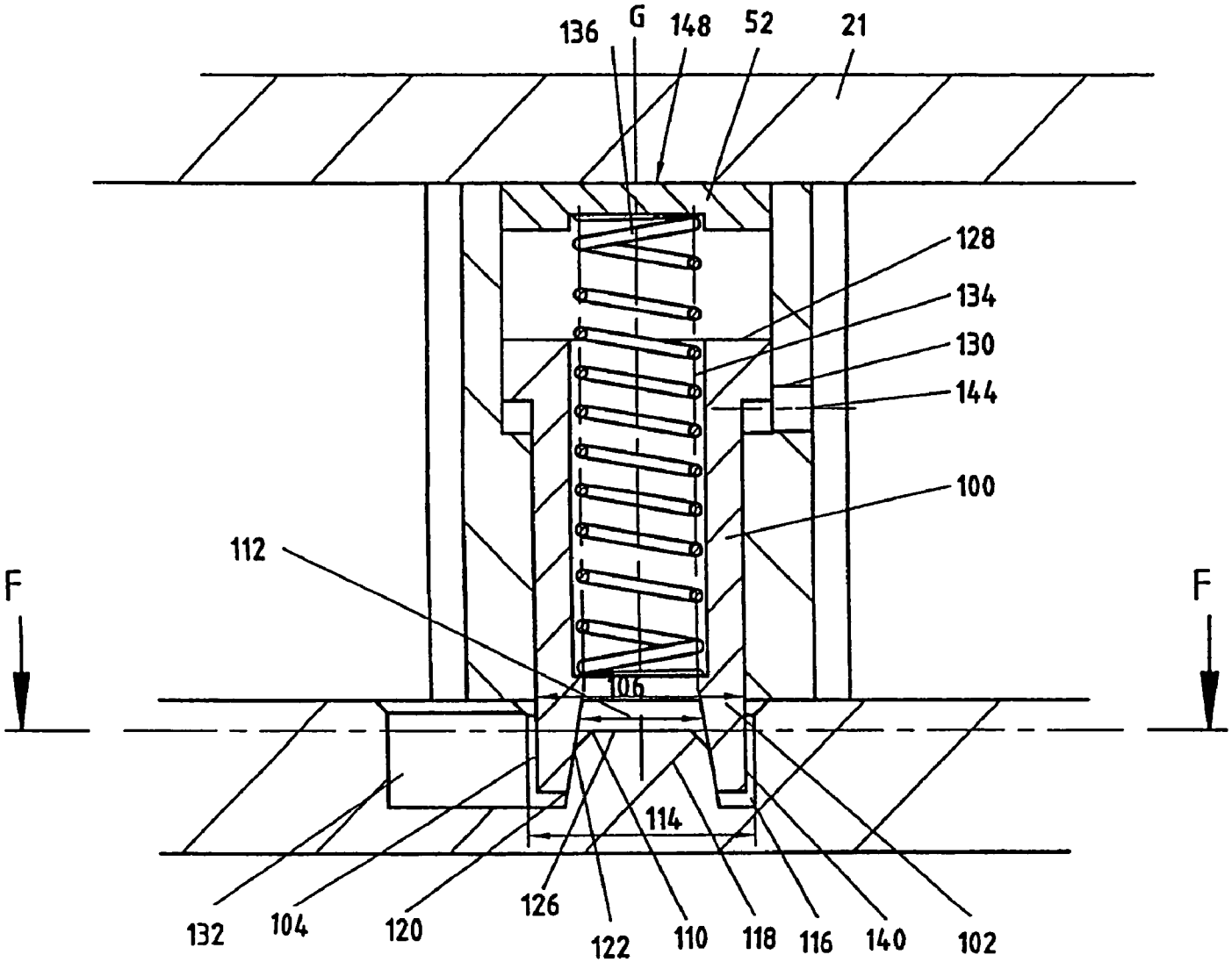
Figure 6:
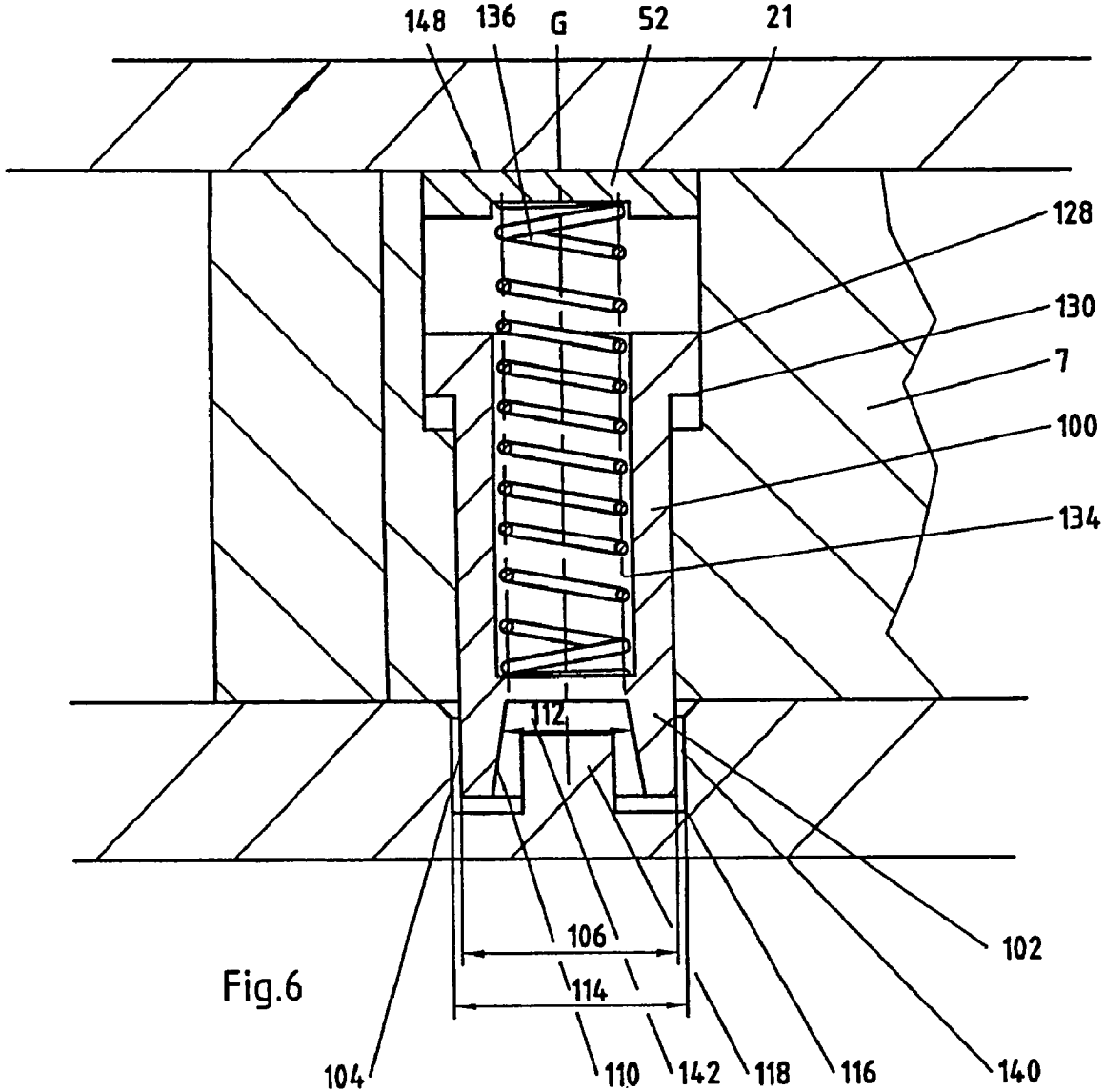
Figure 7:
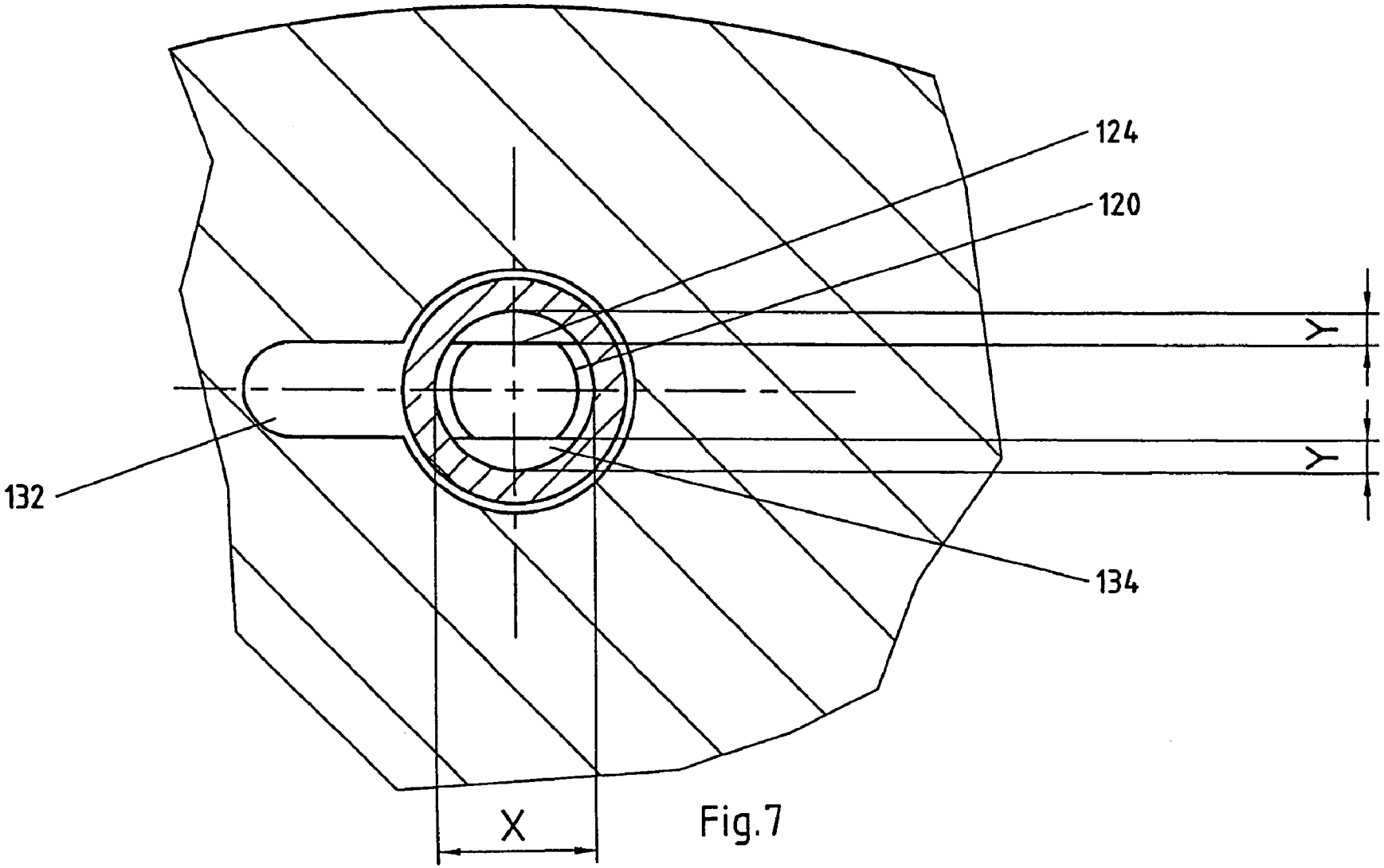

FIGS. 5, 6 and 7, which represent a bar 100 and a receiving opening 116 under a cover 21, are to be referred to for an easier understanding of an appropriate embodiment. The bar 100 has a hollow-drilled shape through which a central opening 134 is formed. The helical spring 136 lies in the central opening 134. The arresting unit 148 is composed of many components, including the bar 100, the helical spring 136, the plate 52 and the receiving opening 116. The actual bar 100 can be divided into a plurality of portions and regions, a first portion 104, a second portion 110, one end 128 of the bar, a collar 130 and a tip 140. The tip 140 is circular such that a space of the wedging portion 142 at one end of the bar is formed as a hollow space. The receiving opening 116 has a particular contour which forms a mandrel 118 having a circular portion 120 and a straight portion 124. The circular portion 120 may be shaped as a frustoconical partial contour 122. The straight portion 124 of the mandrel 118 of the receiving opening 116, together with a part of the second portion 110 of the bar 100, forms an oil duct which opens into the underflow duct 132 communicating with a hydraulic chamber 11 or 13. A positive engagement is formed by means of the frustoconical partial contour 122 together with the second portion 110 of the bar 100 when the arresting unit 148 is in the locked state. The first portion 104 of the bar has a first diameter 106, which lets the bar 100 enter the receiving opening 116 with the diameter 114. The bar can be cut at the plane F which is set back, the mandrel depth, for example, which can be determined as the plane 126 of the bar. If the first diameter 106 and the second diameter 112 of the second portion 110 of the bar 100 are compared with one another in this plane 126, the first diameter 106 is larger than the second diameter 112. The part 102 of the bar which lies in the receiving opening 116 performs the locking function. A collar 130 extends around the end 128 of the bar 100 and is supported at a wall of the arresting unit or at a hole wall of the blade 9. FIG. 7 is a plan view onto or a partial section through the tip 140 of the bar 100. It can be seen that the wall thickness 138 of the tip 140 of the bar 100 is determined by the two diameters 106 and 112. Only a part of the inside diameter is seated on a part of the contour of the mandrel 118. A hollow space or a recess Y is formed where the bar 100 is not seated, in the free region, which space or recess may communicate with the underflow duct 132 in order to enable oil to push back the bar 100 against the helical spring 136 in the entire inside diameter X. FIG. 6 shows the oil chamber which is present while the bar is seated on the mandrel. A further approach duct 144 conveys the hydraulic medium under the collar 130. It is located in the region of the end 128 of the bar 100.

Figure 8:
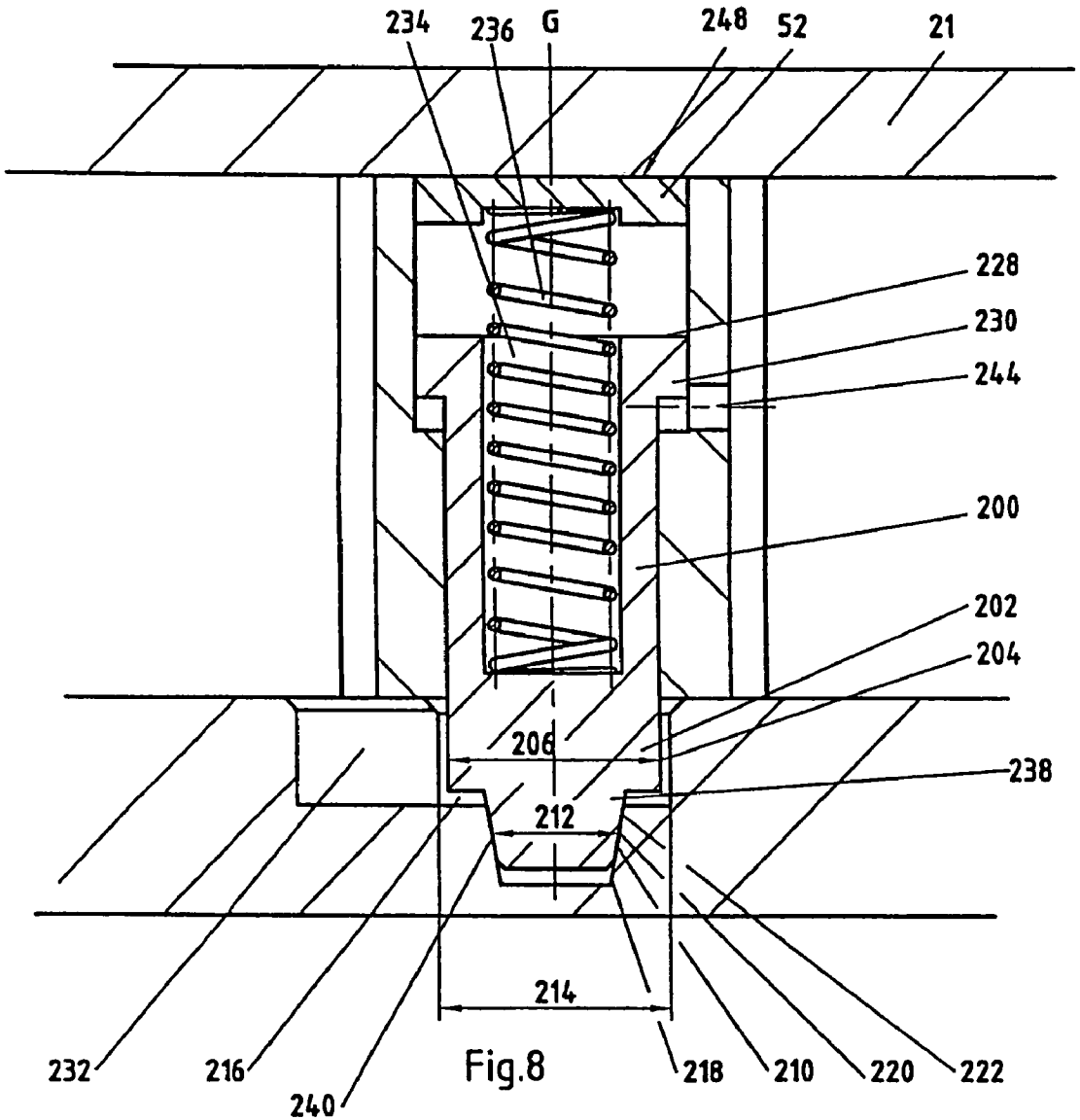
FIG. 8 represents a further embodiment of a camshaft adjuster according to the invention with arresting unit.
Figure 9:
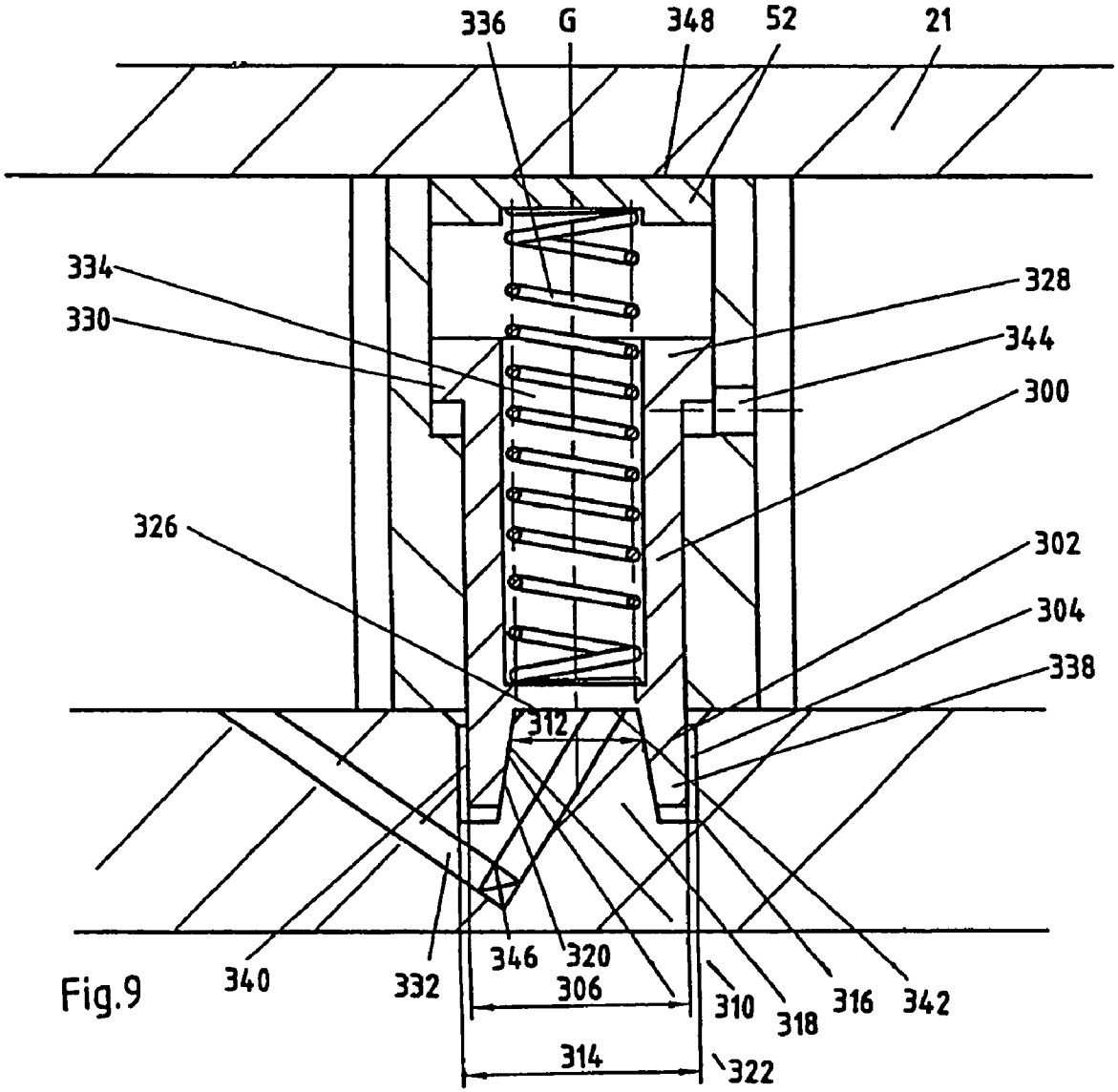
FIG. 9 represents a third embodiment of an arresting unit according to the invention of a camshaft adjuster.

Further embodiments can be seen in FIGS. 8 and 9 of a bar 200 and 300, respectively, according to the invention. Similar parts and components have numbering increased by 100 and 200, respectively, when compared with the constructional variant according to FIGS. 5, 6 and 7. The arresting units 248, 348 differ in details which are to be seen in particular in the region of the tip 240, 340 of the bar 200, 300. The arresting units 248, 348 comprise plates 52, helical springs 236, 336 and receiving openings 216, 316. The diameters of the receiving openings 214, 314 are larger than the first diameters 206, 306 of the first portions 204, 304 of the bars 200, 300. The two bars 200, 300 have similar ends 228, 328. There are collars 230, 330, to which approach ducts 244, 344 lead, in the vicinity of the ends 228, 328.

The bar 200 according to FIG. 8 has a part 202 in which the first portion 204 of the bar 200 with its first diameter 206 can be found. A continuation comprises the second portion 210 of the bar 200, which has a second diameter 212. The diameter 214 of the receiving opening 216 is larger than the first diameter 206 of the first portion 204 of the bar 200. The receiving opening 216 passes into the arresting opening 218. In the represented example both openings, the receiving opening 216 and the arresting opening 218, are disposed coaxially one behind the other along the axis G. It is also conceivable, although this is not represented, for the arresting opening 218 to be disposed eccentrically relative to the receiving opening 216. A circular portion 220 at the tip 240 of the bar 200 is disposed such that it fits into the frustoconical partial contour 220 of the arresting opening 218 such that locking between the tip 240 of the bar 200 and the surface of the arresting opening 218 can be achieved by means of a non-positive engagement. An underflow duct 232 is provided in order to release the non-positive engagement. The underflow duct 232 is supplied with pressurised hydraulic medium. The hydraulic medium passes under the bar 200 and can release it from its press fit against the helical spring 236, which lies in the central opening 234 of the bar 200. The action is augmented by the flow under the collar 230 via the approach duct 244. This enables virtually the entire cross-sectional area of the bar 200 to be used hydraulically.

The tip 340 of the bar 300 according to FIG. 9 differs in part from the tip 240 of the bar 200. One end of the helical spring 336 lies in the central opening 334, the other end of which spring lies against the plate 52. The underflow duct 332 consists of two cross-drilled longitudinal holes which pass into one another and hydraulically connect one hydraulic chamber to the tip of the mandrel 318 in order to enable the bar 300 to be hydraulically pushed into the unlocked position with the underflow via the approach duct 344 under the collar 330. The part 302 of the bar 300 also comprises a first portion 304 with a first diameter 306 and a second portion 310 with a second diameter 312. The diameter 314 of the receiving opening 316 is formed such that the entire part 302 of the bar 300 can be accommodated therein. The mandrel 318, which likewise has a circular portion 320 and a frustoconical partial contour 322, has a mandrel depth which is greater than the mandrel depth F of the embodiment according to FIGS. 5, 6 and 7. The two diameters 306, 312 lie in the same plane 326 of the bar 300. However the plane 326 lies as a whole higher than the plane 126 of the bar 100. Looking into the space 342 of the wedging portion of the bar 300, the tip 340 of the bar 300 is comparable with a pot or a cup, in which pot the mandrel 318 engages. The wall thickness 338 of the bar 300 is defined by means of the differences in the two diameters 306 and 312. The wall thickness 338 may be very small, as long as the first diameter 306 of the bar 300 is dimensioned such that the first portion 304 of the bar 300 securely catches and can transmit the occurring load moment during the locking process. The wall thickness 238 of the bar 200 of FIG. 8 is similarly dimensioned. However in this case the wall thickness 238 also predetermines the underflow face via the underflow duct 232.

Although only three embodiments have been discussed in detail, it is self-evident that, according to one aspect of the invention, these also include bars of a camshaft adjuster in the case of which the presence of two different diameters enables a power transmission change from a static component to a rotating component of the camshaft adjuster to take place during the arresting and wedging process. The simultaneous presence of both diameters in one plane is of advantage. If optimum utilization of the construction space is not important, the diameters for catching and for wedging may be disposed in different planes along one longitudinal axis.

The invention claimed is:

1. A camshaft adjuster according to the swivel motor principle, comprising:

a rotor and a stator, wherein the stator forms by means of webs together with a blade of the rotor, at least two hydraulic chambers acting in opposition, with an arresting unit comprising a biasing means, a bar and a receiving opening corresponding to the bar for receiving a part of the bar, for arresting the rotor in a position relative to the stator;

wherein the bar comprises a first portion, being an advance power transmission portion, which has a first diameter, and a second portion, being a wedging portion, which has a second diameter, wherein the first diameter is larger than the second diameter;

the first and second portions being disposed on the bar such that they are located in the receiving opening during the arresting;

the receiving opening having a larger diameter than the advance power transmission portion; and wherein the arresting firstly occurs by the advance of the first portion moving into the receiving opening, the first portion being subject to play, and the arresting secondly occurs by the second portion moving further into the receiving opening for wedging engagement to minimize play, whereby a stepped change of power transmission takes place during the arresting.

2. A camshaft adjuster as claimed in claim 1, also wherein the wedging portion is a mandrel which preferably engages in the longitudinal axis of the bar.

3. A camshaft adjuster as claimed in claim 2, also wherein the mandrel comprises at least one circular portion, which has a frustoconical partial contour, and preferably at least one straight portion.

4. A camshaft adjuster as claimed in claim 1, also wherein the first diameter and the second diameter lie in the same plane of the bar.

5. A camshaft adjuster as claimed in claim 1, also wherein the wedging portion has a contour which, symmetrically in surface contact with the corresponding receiving opening, produces a wedging effect, in particular by means of frustoconical portion contours.

6. A camshaft adjuster as claimed in claim 1, also wherein the first diameter is a diameter of a cylindrical rod and the second diameter is a frustoconical diameter.

7. A camshaft adjuster as claimed in claim 1, also wherein the bar comprises at one end, in particular the end which is remote from the receiving opening, a circumferential collar under which hydraulic medium can flow, and the bar comprises a central opening in which the biasing means, in particular a helical spring, engages, so that the bar has in particular the shape of a cover cap, wherein another side of the biasing means is preferably supported at the plate.

8. A camshaft adjuster as claimed in claim 1, also wherein a hydraulic medium can flow under the bar through ducting on the side which is near the receiving opening.

9. A camshaft adjuster as claimed in claim 1, also wherein a tip of the bar is a circular ring, the wall thickness of which increases continuously in the direction away from the receiving opening.

10. A camshaft adjuster as claimed in claim 2, also wherein the mandrel is of a smaller height than the space which is formed by the wedging portion.

* * * * *